US005105082A

United States Patent [19]

Maruo et al.

[11] Patent Number: 5,105,082

[45] Date of Patent: Apr. 14, 1992

[54] LASER IONIZATION SPUTTERED NEUTRAL MASS SPECTROMETER

[75] Inventors: Tetsuya Maruo, Kodaira; Yoshikazu Honma, Tokyo; Satoru Kurosawa, Kokubunji, all of Japan

[73] Assignee: Nippon Telegraph & Telephone Corporation, Tokyo, Japan

[21] Appl. No.: 680,916

[22] Filed: Apr. 5, 1991

[30] Foreign Application Priority Data

Apr. 9, 1990 [JP] Japan ..... 2-92125
Jun. 22, 1990 [JP] Japan ..... 2-162654
Jun. 25, 1990 [JP] Japan ..... 2-164066

[51] Int. Cl.[5] ..... H01J 49/04

[52] U.S. Cl. ..... 250/288; 250/287; 250/309

[58] Field of Search ..... 250/288, 281, 282, 287, 250/309, 286

[56] References Cited

U.S. PATENT DOCUMENTS 4,733,073 3/1988 Becker et al. ..... 250/288

OTHER PUBLICATIONS

J. B. Pallix et al., Depth Profiling Using Intense UV Laser Ionization of Sputtered Neutrals, pp. 1-9, 1988, North-Holland, Amsterdam.

C. H. Becker, On the Use of Nonresonant Multiphoton Ionization of Desorbed Species for Surface Analysis, pp. 1181-1185, Jul./Aug. 1987.

C. M. Stahle et al., Quantitative Measurements of the Stoichiometry of Anodic Oxides Grown on $Hg_{0.78}Cd_{0.22}Te$, pp. 521-523, Sep. 1, 1985.

C. H. Becker et al., Nonresonant Multiphoton Ionization as a Sensitive Detector of Surface Concentrations and Evaporation Rates, pp. 1063-1065, Nov. 15, 1984.

Christopher H. Becker et al., Surface Analysis by Nonresonant Multiphoton Ionization of Desorbed or Sputtered Species, pp. 1671-1674, 1984.

*Primary Examiner*—Jack I. Berman
*Attorney, Agent, or Firm*—Spencer & Frank

[57] ABSTRACT

An ion beam is impinged against a solid sample to sputter neutrals. The neutrals thus sputtered are ionized by a UV laser beam to obtain photoions. The photoions are guided to a quadrupole mass analyzer through an ion extraction electrode to extract ions having a desired mass. The extracted ions are made incident upon an ion detector to derive ion pulses. The number of ion pulses is counted by a counter through a signal gate which is opened only during a time period that the photoions reaches the ion detector. A mass of the neutrals having a desired mass is analyzed from the counted value in the digital manner. A time period required for extracting the photoions is extended to perform the pulse counting without being influenced by the secondary ions which causes noises, so that the mass analysis can be performed with a high sensitivity.

13 Claims, 9 Drawing Sheets

LASER IONIZATION SPUTTERED NEUTRAL MASS SPECTROMETER

BACKGROUND OF THE INVENTION

1. Field of the Invention

The present invention relates to a laser ionization sputtered neutral mass spectrometer in which a mass spectrometric analysis is carried out by determining a mass spectrum of a photoion formed by ionizing a neutral by UV laser rays among particles which are sputtered by irradiation of a solid sample, i.e., a substance to be analyzed, with an ion beam.

2. Description of the Prior Art

As typical methods for trace analysis of solid samples, there has been known the secondary ion mass spectrometry in which secondary ions sputtered from the surface of a sample through the irradiation with an ion beam are detected. However, since the secondary ion yield is low and a quantity of the secondary ions greatly varies depending on a kind of element, the quantity is not in proportion to the concentration of a specific element present in the sample and, therefore, this method suffers from a problem of precision from the viewpoint of quantitative analysis.

On the other hand, the quantity of the neutrals which are sputtered from the sample simultaneously with the secondary ions is in proportion to the concentration of the corresponding element present in the sample and, therefore, the sputtered neutral mass spectrometry in which neutrals are detected is an analytical method which can provide a high precision from the viewpoint of quantitative analysis. In particular, it has been known that the laser ionization sputtered neutral mass spectrometry in which neutrals are ionized by the irradiation with laser rays is a method capable of providing high ionization efficiency (see, for instance, C. H. Becker, J. Vac. Sci. Technol., 1987, A5, p. 1181).

However, the secondary ion mass spectrometry has a sensitivity in measurement more excellent than that achieved by the conventional sputtered neutral mass spectrometer, since the latter suffers from problems as will be discussed below. A measure for solving the foregoing problem is to simultaneously detect both neutrals and secondary ions, but the secondary ions cannot be detected with a high sensitivity by the conventional apparatuses. The outline of the conventional laser ionization sputtered neutral mass spectrometers will hereunder be described and the problems concerning the sensitivity in measurement, detection of secondary ions or the like thereof will be clarified below.

FIG. 1 shows an example of a conventional laser ionization sputtered neutral mass spectrometer. In FIG. 1, reference numeral 1 represents an ion source which generates an ion beam 2 through the ionization of a gas such as argon or oxygen or metal vapor. The ion beam 2 is converged by an electrostatic lens 3 and then pulsed by an ion-pulsing electrodes 4 to bombard the surface of a solid sample 5. Neutrals and secondary ions are discharged from the surface of the solid sample 5 through the bombardment with the sputter ion beam 2. The secondary ions 6 are extracted by an ion extraction electrode 7, but the neutrals 8 reach a photoionization region 9 at a velocity lower than that of the secondary ion 6, since they are not accelerated. In the photoionization region 9, the neutrals 8 are irradiated by UV laser rays 11 generated in a UV laser light source 10 and thus are photoionized to form photoions 12. The photoions 12 are extracted by the ion extraction electrodes 7, then passed through a time of flight type mass analyzer 13 and then converted into current signals in an ion detector 14. The current signals outputted from the ion detector 14 are detected as a current by a measuring instrument such as digital oscilloscope 15.

A first technique for detecting photoions comprises performing mass separation of photoions generated within a very short period of time. In this respect, a generation-time duration for the photoions 12 which are generated through the bombardment with the UV laser rays 11 is of the order of about several tens of nanoseconds. A time of flight type mass analyzer 13 is used for determining the quantity of the photoions 12 generated within such a short period of time. In such a time of flight type mass analyzer 13, the mass separation is performed by making the most use of the fact that among particles almost simultaneously generated, the lower the mass of particles, the shorter a time required for arriving at a detector, while the higher the mass of particles, the longer a time required for arriving at the detector.

A second technique for detecting photoions comprises separating the secondary ions 6 from the photoions 12. The secondary ions 6 discharged from the surface of the sample 5 interfere the detection of the photoions 12. The methods of this kind can be classified into two groups.

In the first method, an ion beam 2 is pulsed synchronously with laser rays 11 as shown in FIG. 1. Thus, pulsed secondary ions and pulsed neutrals are generated from the surface of the sample 5 by the action of the pulsed ion beam 2. The secondary ions 6 per se are accelerated towards the detector 14. On the other hand, the neutrals 8 move towards an ionization region while maintaining the initial velocity thereof and are accelerated only after the ionization by the irradiation with laser rays 11. For this reason, a difference in time required for arriving at the detector between the secondary ions and the neutrals arises. Thus, the detection of the secondary ions and the photoions can be performed, while making use of such a difference in the detection time.

The second method comprises accelerating the secondary ions by applying an energy greatly different from that for the photoions. There have been known a variety of such methods. For instance, as shown in FIG. 2, an electrode 16 is disposed between a sample 5 to be analyzed and a photoionization region 9 to thus cause repulsion of the second ions, thereby guiding only the neutrals into the ionization region 9.

A third technique for detecting the photoions is to use a means for detecting ions. The photoions are converted into a current by an ion detector and measured by a detector such as a digital oscilloscope.

As has been explained above, the conventional apparatuses principally comprises a time of flight type mass analyzer, a means for separating secondary ions and a detector which measures a quantity of electric current. However, the conventional apparatuses having such a construction suffer from the following problems when they are used in analysis requiring a high sensitivity. In the high sensitive analysis, it is necessary to carry out measurements over several times and to accumulate the data obtained, but the accumulated speed in the apparatus is very low, because the data outputted from the current detector such as a digital oscilloscope are twodimensional data, i.e., a change in current with respect to time. Moreover, the conventional measuring instruments for detecting a current do not have a sufficient dynamic range for detecting an ion current originated from constituent elements of a sample to be analyzed and for detecting a quite low current derived from trace impurities and, therefore, cannot detect a quite low current. In addition, it is required to keep the photoionization region 9 away from the surface of the sample 5 to some extent in order to separate the secondary ions from the photoions, even if either of the methods for changing time and acceleration energy is adopted. This results in the reduction in a solid angle of photoionization and hence the reduction of an amount of neutrals to be ionized. For this reason, the sensitivity of these apparatuses is low and is of the order of ppm (see, for instance, C. H. Becker, J. Vac. Sci Technol., 1987, A5, p. 1181).

In respect of the determination of secondary ions, these apparatuses make it possible to detect the secondary ions. In this case, however, it is necessary to pulse the ion beam for sputtering the sample and the apparatuses are insufficient for use as a high sensitive secondary ion detector. As has been explained above, it has been difficult so far to carry out an analysis with a high sensitivity and an analysis of secondary ions when the conventional laser ionization sputtered neutral mass spectrometer is used.

SUMMARY OF THE INVENTION

Accordingly, an object of the present invention is to provide a laser ionization sputtered neutral mass spectrometer which can achieve a high sensitivity and which makes it possible to carry out the analysis of secondary ions.

Another object of the present invention is to provide a laser ionization sputtered neutral mass spectrometer which is capable of a simultaneously carrying out analysis of neutrals and analysis of secondary ions, while making the most use of the advantages of both the sputtered neutral mass spectrometry and the secondary ion mass spectrometry.

In order to achieve the object, a laser ionization sputtered neutral mass spectrometer comprises:

a vacuum chamber;

a pulse laser means disposed in the vacuum chamber for irradiating an ion beam on a surface of a solid sample to be analyzed;

means for generating a UV pulse laser beam for ionizing neutrals sputtered from the surface of the solid sample by bombardment with the ion beam to generate photoions, and which is capable of repeatedly emitting laser pulses;

a mass separation means disposed in the vacuum chamber for mass-separating and passing, therethrough, only ions having a desired mass of at least one of secondary ions and the photoions sputtered from the surface of the solid sample through the bombardment with the ion beam;

an ion detecting means for detecting the ions derived from the mass separation means to output pulse outputs;

a gate means for extracting the pulse outputs from the ion detecting means only during a period of time from an instant that the photoions passing through the mass separation means reach the ion detecting means to an instant that the ions are detected; and a counting means for counting the number of the pulse outputs extracted from the gate means.

Here, the mass separation means may be a quadrupole mass analyzer.

The laser ionization sputtered neutral mass spectrometer may further comprise a condenser lens for converging the laser beam from the pulse laser means and means for adjusting a converging position of the laser beam so that the converging position is positioned immediately above the surface to be sputtered of the solid sample.

The laser ionization sputtered neutral mass spectrometer may further comprise a condenser lens for converging the laser beam from the pulse laser means and means for adjusting a converging position of the laser beam so that the converging position is positioned immediately above the surface to be sputtered of the solid sample.

The laser ionization sputtered neutral mass spectrometer may further comprise ion optics disposed in a prestage of the quadrupole mass analyzer and for removing only ions having a high energy among the photoions generated.

The laser ionization sputterred neutral mass spectrometer may further comprise ion optics disposed in a prestage of the quadrupole mass analyzer and for removing only ions having a high energy among the photoions generated.

The laser ionization sputtered neutral mass spectrometer may further comprise means for changing the gate-opening time and gate-closing time of the gate means depdning on the mas and the kinetic energy of the photoions.

The laser ionization sputtered neutral mass spectrometer may further comprise means for changing an instant that the gate means is opened and an instant that the gate means is closed in accordance with the mass and the kinetic energy of the photoions.

The laser ionization sputtered neutral mass spectrometer may further comprise means for changing an instant that the gate means is opened and an instant that the gate means is closed in accordance with the mass and the kinetic energy of the photoions.

The laser ionization sputtered neutral mass spectrometer may further comprise means for changing an instant that the gate means is opened and an instant that the gate means is closed in accordance with the mass and the kinetic energy of the photoions.

The laser ionization sputtered neutral mass spectrometer may further comprise means for changing an instant that the gate means is opened and an instant that the gate means is closed in in accordance with the mass and the kinetic energy of the photoions.

The laser ionization sputtered neutral mass spectrometer may further comprise means for simultaneously enabling or disabling the generation of the laser beam from the pulse laser means and the gate means, the photoions being detectd when the pulse laser means and the gate menas are enabled, and the secondary ions being detectd when the pulse laser means and the gate means are disabled.

The laser ionization sputtered neutral mass spectrometer may further comprise means for setting an energy of the ion optics at a level which provides the highest sensitivity with respect to the secondary ions while the secondary ions are detected.

In the present invention, a laser beam is brought to the surface to be sputtered as close as possible. To this end, a solid angle of the ionization of neutrals is increased to a level greater than that achieved by the conventional methods and hence a quantity of photoions increases. To suppress the detection of the secondary ions, an ion detection time-limiting means is used as a second means.

As is shown in FIG. 3, photoions are generated discretely in synchronous with the emission of a laser, while the secondary ions are continuously generated. The density of the photoions generated is greater than that of the secondary ions, but an interval of the intermittent generation of the photoions is substantially longer than that shown in FIG. 3 and, therefore, an integrated value of the photoions is smaller than that for the secondary ions.

Thus, the detector is designed so that it operates only during a period of time within which the photoions may possibly be detected. Accordingly, the intensity of the secondary ion can be reduced in proportion to the measuring time which is shortened by the limiting means. For instance, if the interval of the measuring time is set at 1 μsec for repeated measurements over one second, the intensity of the secondary ion thus becomes 1/106. The time interval of the order of 1 to several tens of microseconds is suitable, as will be explained below.

Furthermore, an electric field- or magnetic field-sweeping type mass spectrometer is employed as a third means. This mass spectrometer performs the mass separation of only ions of a predetermined kind, unlike the conventional methods, in which all the photoions having various masses are detected at one time. Since only ions having a predetermined mass can thus be detected by this mass spectrometer, only the photoions of trace impurities can be determined without any influence of the secondary ions derived from the constituent elements having high intensities. Although the secondary ions are not completely separated from the photoions as in the conventional methods, the intensity of the secondary ions can be suppressed to an extent that it can be neglected by these second and third means.

A fourth means for enhancing the sensitivity of the analysis is a high repetition rate pulse laser. It is necessary to accumulate the data for ensuring a high sensitivity of the measurement. The data obtained by the detector used in the present invention are one-dimensional data simply of ion intensities unlike the conventional methods and, therefore, the processing of the one-dimensional data does not require so much time. An accumulated repetition speed is dependent upon an emission repetition frequency of a laser pulse and accordingly the frequency of a laser currently available on the market is of the order of several hundreds to several thousands of hertz.

Further, a pulse counting means is employed as a fifth means. Since in the conventional methods, a time required for ions arriving at a detector corresponds to the mass of the ions, it is necessary to shorten a time interval required for detecting the ions each having one specific mass value as short as possible in order to improve the mass resolution. It is necessary that this time interval be of the order of several tens of nanoseconds. On the other hand, a pulse width required for converting an ion into a quantity of current is 10 to 20 nsec and thus pulses generated by a plurality of ions are superimposed with respect to one specific mass value in the conventional method. For this reason, the quantity of ions is expressed as an analog value, i.e., a height of pulse.

On the contrary, a pulse counting method for counting the number of ions is employed in the present invention. In other words, the number of ions can be expressed as a digital quantity in the present invention. This is because the mass resolution is not reduced and, therefore, a time duration for measuring ions can be extended as compared with the conventional methods. Accordingly, the superposition of pulses can be prevented.

The difference between the measuring methodsd of the present invention and the convention techniques is shown in FIG. 3A. The pulse counting is likely not to be influenced by noises. In order to extend a time duration for measurement, the difference between initial velocities of discharged neutrals is utilized. On the other hand, a very high extraction voltage is applied to particles having different initial velocities to adjust the initial velocities thereof to be substantially the same. To the contrary, if any extraction voltage is not applied to the particles, the difference in the initial velocities as such is reflected to the difference in times required for the particles to arrive at a detector. The initial energy of the neutral discharged from the sample varies depending on various factors such as sputtering conditions, kinds of the samples and so on, but in general ranges from several electron volts to several tens of electrons volts.

A time required for ions to arrive at the ion detector (arrival time) is in proportion to the reciprocal of a kinetic energy of the ions. Therefore, if all of the generated photoions having various energies are detected without applying any extraction voltage after the ionization of the neutrals, there is observed a considerable difference between the arrival times of ions having highest velocity and those having the lowest velocity, which is almost equal to several times the arrival time of the fastest ions. As a result, a very long detection time can be established.

Furthermore, a detection time can be adjusted by varying the extraction voltage within the range from several voltages to several tens of voltages. It is very effective to adjust this detection time at every time that ions existing in various quantities are detected. As has been discussed above, as the detection time increases, a greater amount of ions can be pulse-counted, but simultaneously an amount of detected secondary ions is likewise increased. For this reason, the detection sensitivity is improved by extending the detection time when a large amount of ions are present or by shortening the detection time when only a small amount of ions is presnt. A mass spectrometer which is preferable to detect ions having an energy of such a level is a quadrupole mass analyzer.

In addition, the apparatus according to the present invention makes it possible to analyze a sample in the direction of its depth, unlike the conventional laser ionization sputtered neutral mass spectrometer, and uses a highly sensitive electric field-sweeping or magnetic field-sweeping type mass analyzer which is likewise used in the conventional secondary ion mass specctrometry. Therefore, the apparatus of the present invention makes it possible to perform the analysis in a high sensitivity almost comparable to the sensitivity achieved by the conventional secondary ion mass spectrometer. In the practical apparatus, the continuous detection of neutrals and secondary ions having any arbitrary mass can be performed by controlling the foregoing measuring time-limiting means and the pulse laser by a data processor which has various functions, for instance, establishment of the mass to be detected by the mass analyzer and recording of the measured data.

The above and other objects, effects, features and advantages of the present invention will become more apparent from the following description of the embodiments thereof taken in conjunction with the accompanying drawings.

DETAILED DESCRIPTION OF THE PREFERRED EMBODIMENTS

EMBODIMENT 1

Figure 4:
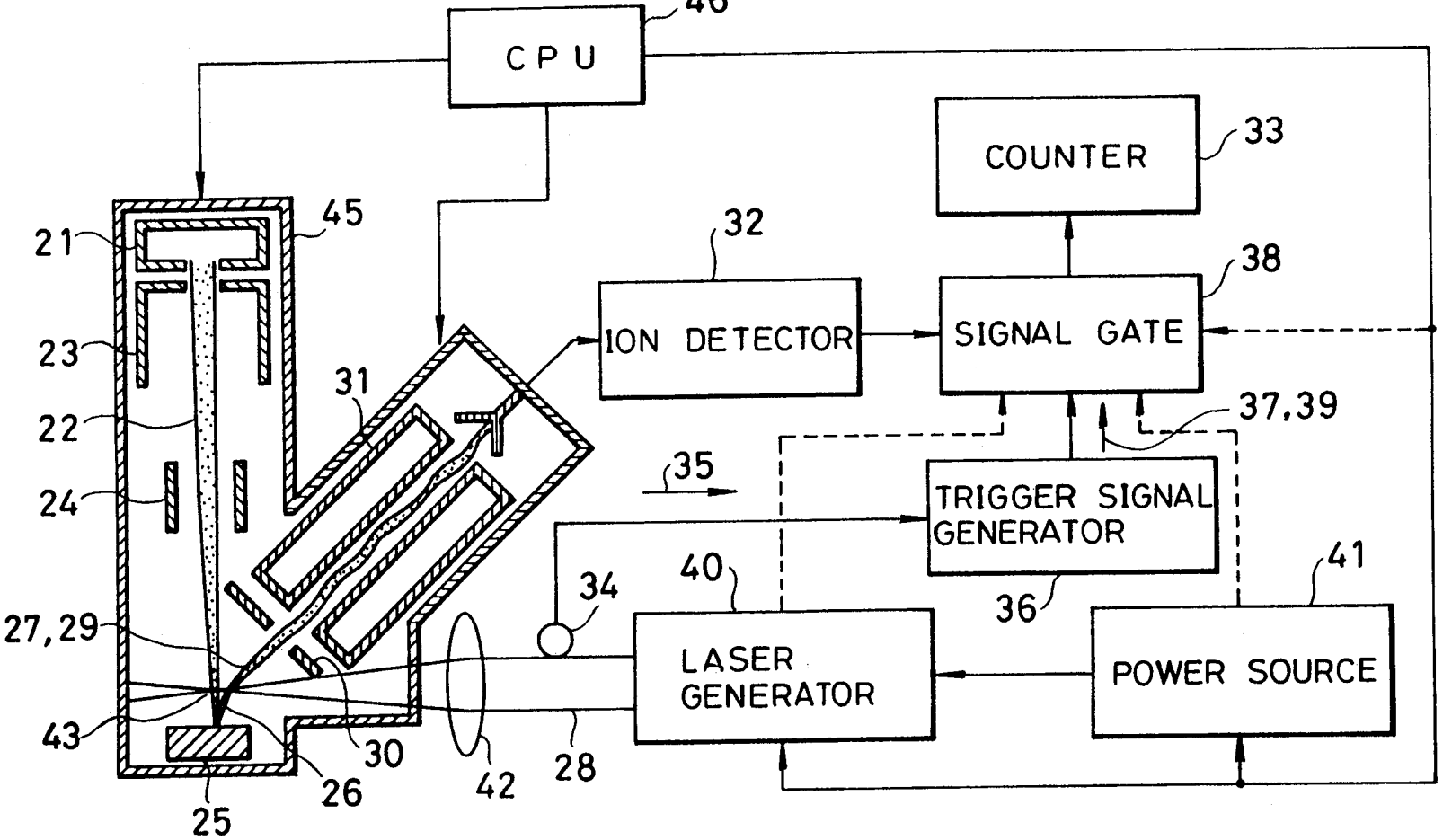
FIG. 4 is a schematic diagram showing an embodiment of an apparatus according to the present invention.

FIG. 4 shows an entire arrangement of Embodiment 1 of the present invention. In FIG. 4, reference numeral 21 denotes an ion source which emits a continuous ion beam 22. Reference numeral 23 denotes an electrostatic lens for converging the ion beam 22. Reference numeral 24 denotes a scanning electrode for deflecting the converged ion beam 22 to bombard the surface of a sample 25 with the resulting scanning ion beam 22. The region in which neutrals 26 are generated through the bombardment of the sample 25 with the ion beam 22 is irradiated with a UV laser beam 28 from a laser generator 40 through a condenser lens 42 to ionize the neutrals 26 to obtain photoions 29. Reference numeral 30 represents an extraction electrode for extracting the photoions 29 from an ionization region 43 to guide them to a quadrupole mass analyzer 31. In the quadrupole mass analyzer 31, the neutrals 26 are mass-separated by the separation of masses of the desired photoions 29.

Ions having a mass to be measured which are mass-separated in the quadrupole mass analyzer 31 are detected by an ion detector 32 and the resulting ion pulses are supplied to a counter 33 through a signal gate 38. The details of the signal gate 38 will be described below. Reference numeral 45 represents a vacuum chamber for accommodating the ion source 21, the electrostatic lens 23, the scanning electrode 24, the sample 25, the extraction electrode 30 and the quadrupole mass analyzer 31. Reference numeral 46 represents a central processing unit or CPU for controlling the ion source 21, the electrostatic lens 23, the scanning electrode 24 and the extraction electrode 30, the mass analyzer 31, the laser generator 40 and a power source 41 for the laser generator 40.

Figure 1:
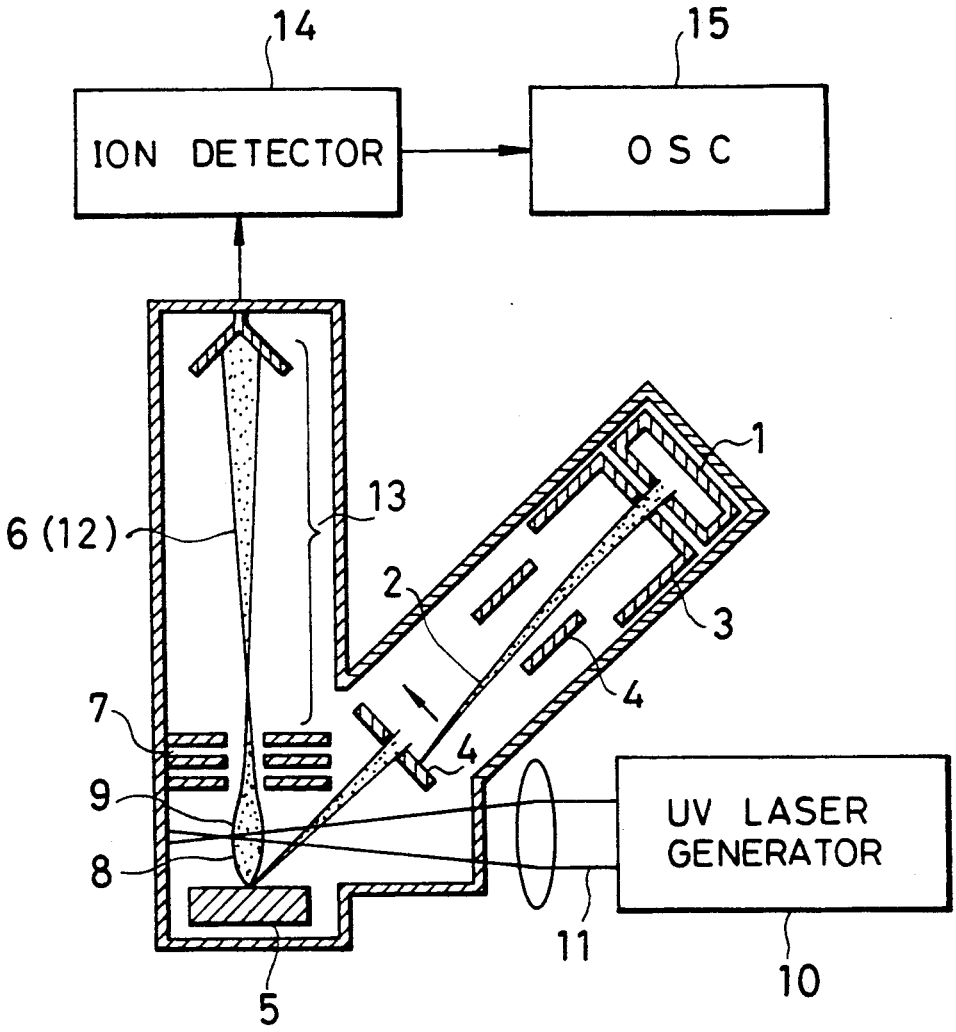
FIG. 1 (PRIOR ART)
FIG. 1 is a schematic diagram showing an example of a conventional apparatus.
Figure 2:
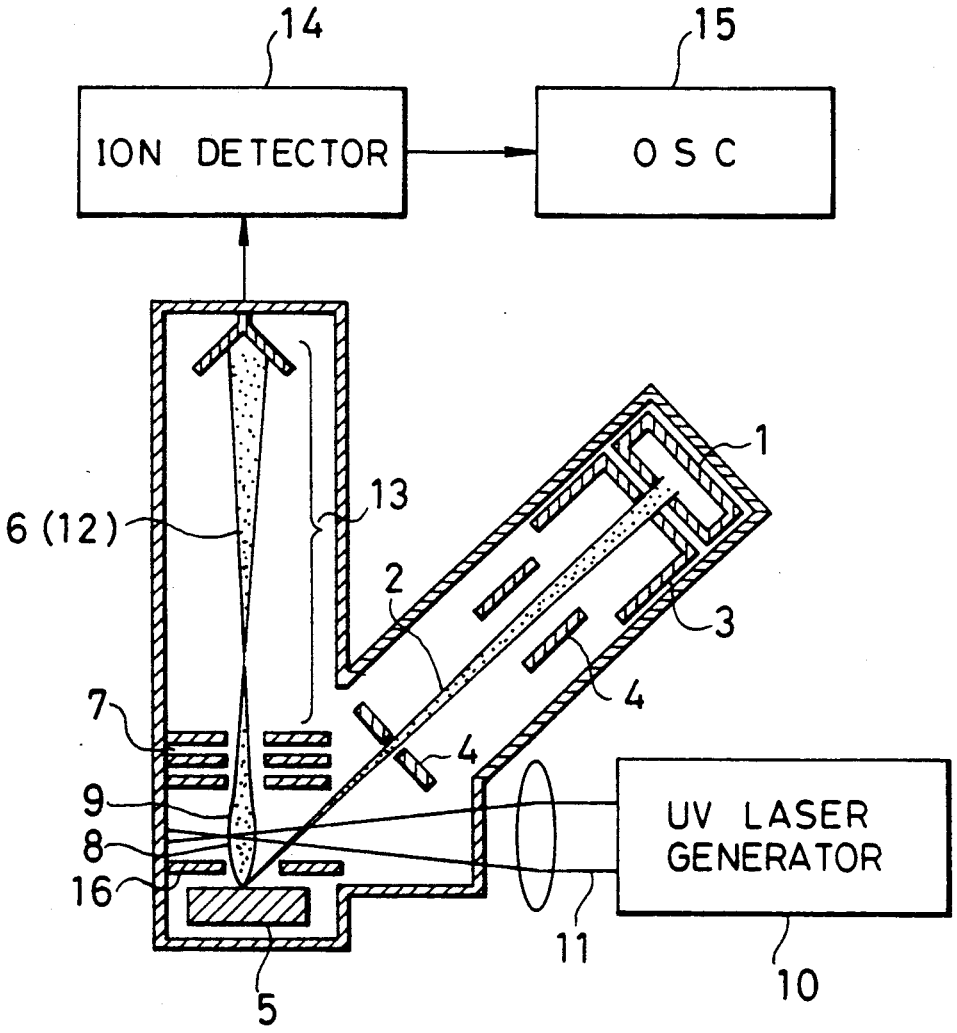
FIG. 2 (PRIOR ART)
FIG. 2 is a schematic diagram showing another example of a conventional apparatus.
Figure 3:
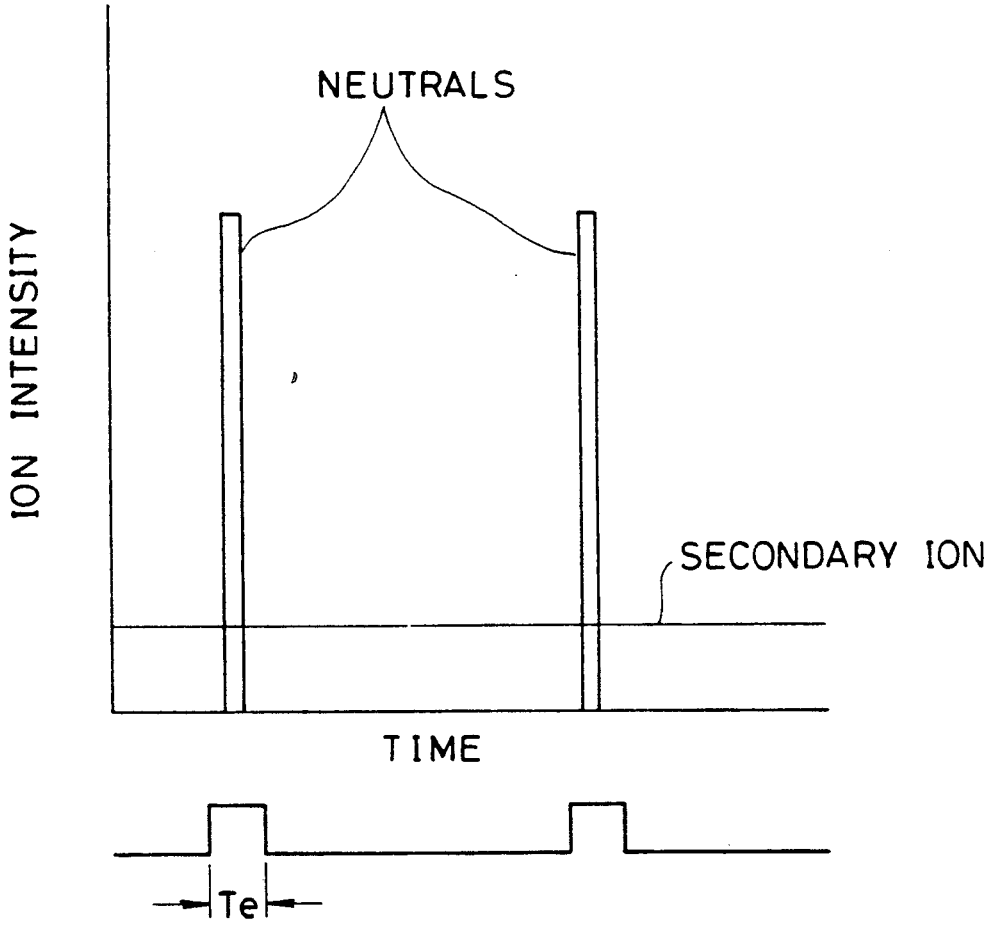
FIG. 3 is an explanatory diagram illustrating a mechanism of generating photoions and secondary ions.
Figure 3A:
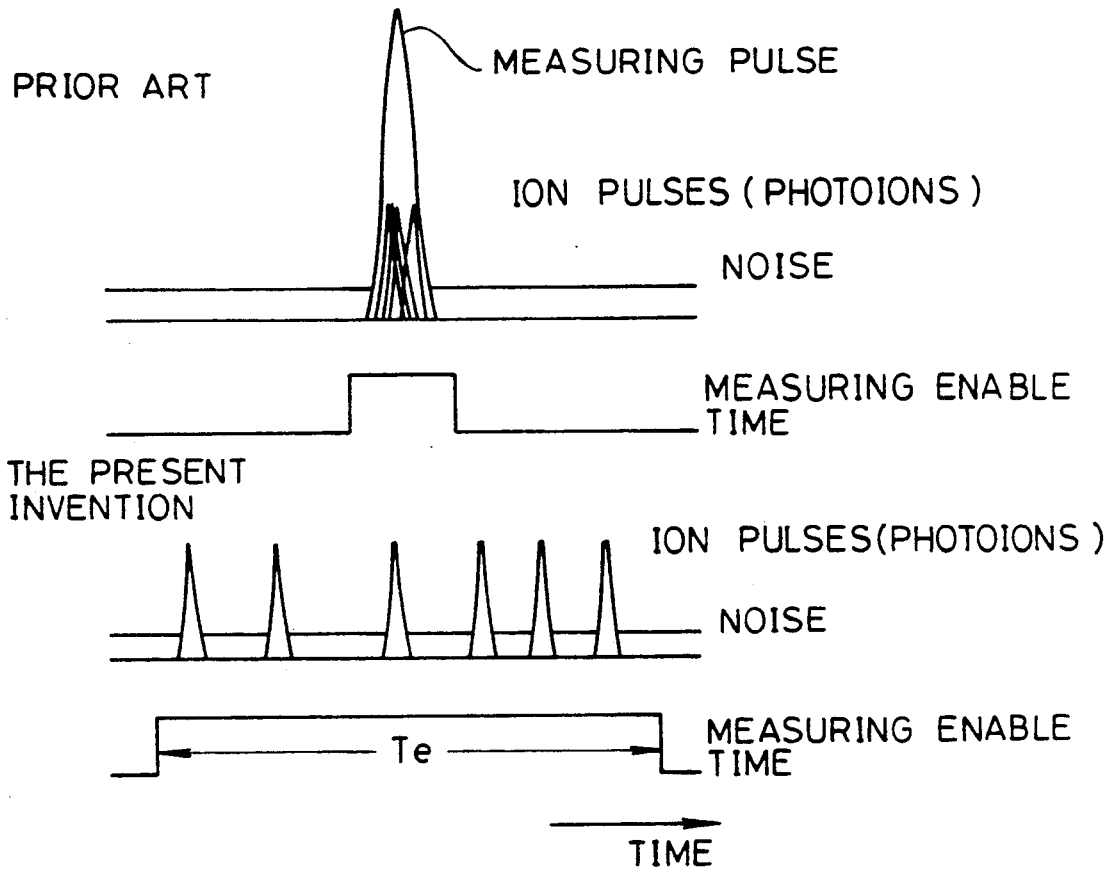
FIG. 3A is an explanatory diagram illustrating a measuring method of the present invention in comparison with a conventional measuring method.

In the arrangement explained above, secondary ions 27 generated from the sample 25 are also guided to the quadrupole mass analyzer 31 by the extraction electrode 30 and likewise mass-separated by the quadrupole mass analyzer 31. This quadrupole mass analyzer 31 cannot separate the secondary ions 27 from the photoions 29. More specifically, since the secondary ions 27 are mixed in the photoions 29 as a continous noise as shown in FIG. 3, a quantity of the intermittently generated photoions 29 having a high peak value is smaller than an integrated value of the secondary ions. In the present invention, the gate 38 is opened only during the period of time that ion pulses are generated to thereby extract the ion pulses.

Further, if a quadrupole mass analyzer is used, photoions derived from impurities present in the sample can be determined without any influence of secondary ions which are derived from the constituent elements of the sample and have a high intensity. If it is assumed that the mass of the secondary ion is identical with that of the photoion, the photoions are generated frequently by an amount corresponding to 2 to 5 figures more than the secondary ion, although the generation frequency varies depending on various factors such as a pulse width of the laser, a gate time duration by ion-limiting means and a yield of the secondary ions. As a result, the influence of the secondary ions can be neglected during the gate time duration.

An embodiment of the aforementioned signal gate or means for limiting the time for extracting the ion pulses will be hereunder described. A laser detector 34 emits a light emitting signal 35 which indicates whether the laser beam 28 is generated or not. The signal 35 is supplied to a trigger signal generator 36, which generates a detection initiation signal 37 after the lapse of a predetermined delay time which corresponds to a period of time (of the order of several microseconds to several tens of microseconds) required from an instant that this signal 35 is inputted to the trigger signal generator 36 to an instant that the photoions 29 are detected by the ion detector 32. The detection initiation signal 37 is applied to the signal gate 38 disposed between the ion detector 32 and the pulse counter 33, so that ion pulses inputted to the ion detector 32 at and after an instant that the detection initiation signal 37 is supplied to the signal gate 38 are detected.

Since a period of time from an instant that the photoions are generated to an instant that the photoions are converted into pulse signals would be several microseconds to several tens of microseconds, a delay time of the order of several microseconds to several tens of microseconds is needed between the reception of the light emitting signal 35 and the generation of the detection initiation signal 37.

The counting can be terminated by a detection termination signal 39 which is derived from the trigger signal generator 36 and applied to the signal gate 38. According to such operations, the ion pulse detection can be carried out only during the period of time that the photoions are being generated. Alternatively, the laser light emitting signal 35 to be inputted to the trigger signal generator 36 may be generated from the laser generator 40, the laser power source 41 or the CPU 46. In such a case, it is a matter of course that a delay time for generating the detection initiation signal must be changed accordingly.

Figure 5:
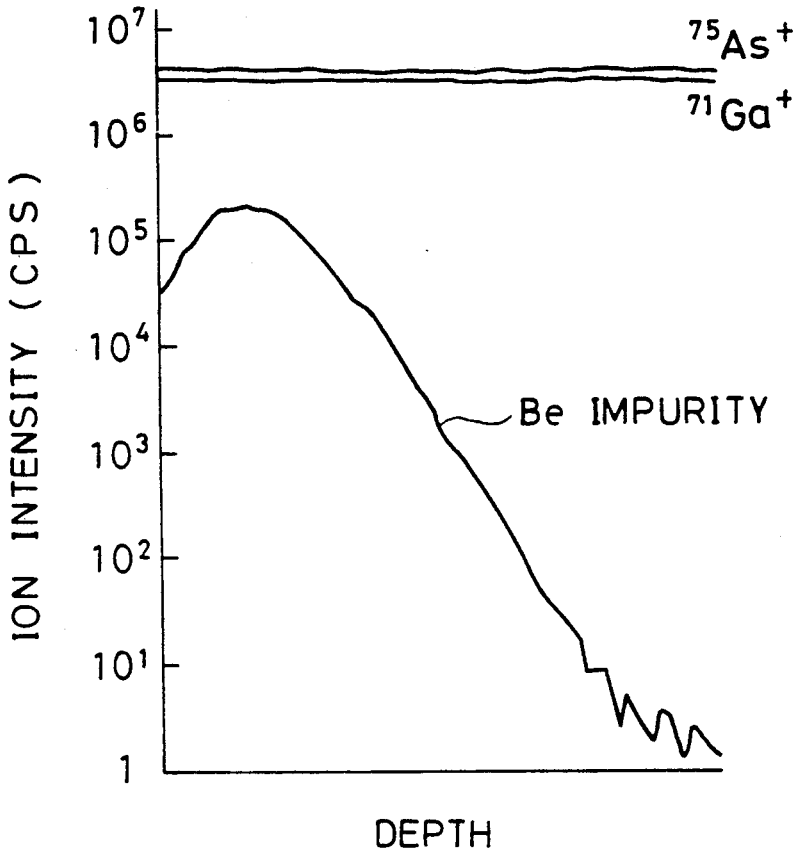
FIG. 5 is a characteristic curve graph illustrating a relation between the ion intensity (CPS) and the depth of the sample, which is, in this case, ion-implanted GaAs.

An example of mass analysis was performed using the apparatus of the embodiment explained above. Results thus obtained are plotted in FIG. 5. FIG. 5 illustrates a relation between an impurity ion intensity and a depth of a sample analyzed which was observed on the GaAs to which impurity element, Be, was implanted. A fact that the ion intensities of Ga and As are approximately identical to one another is one of the characteristic properties of the sputtered neutral mass spectrometry. The results of this experiment clearly indicate that the detection of the impurity, Be, can be performed at a sensitivity of the order of ppm or less.

EMBODIMENT 2

Neutrals which are sputtered from the surface of the sample 25 are discharged in all the directions in the space of the vacuum chamber 45. Since the laser beam 28 passes through only a part of the space, only a part of the neutrals can correspondingly be photoionized. For this reason, it is needed to bring a position through which the laser beam 28 passes to the surface to be sputtered as close as possible to the surface in order to increase a quantity of the neutrals. Moreover, the higher a photon density, the greater a photoionization efficiency, and the laser beam 28 is preferably converged to a diameter of the order of several hundreds of microns, since the radius of the sputtered ion is of the order of 100 μm.

Figure 6:
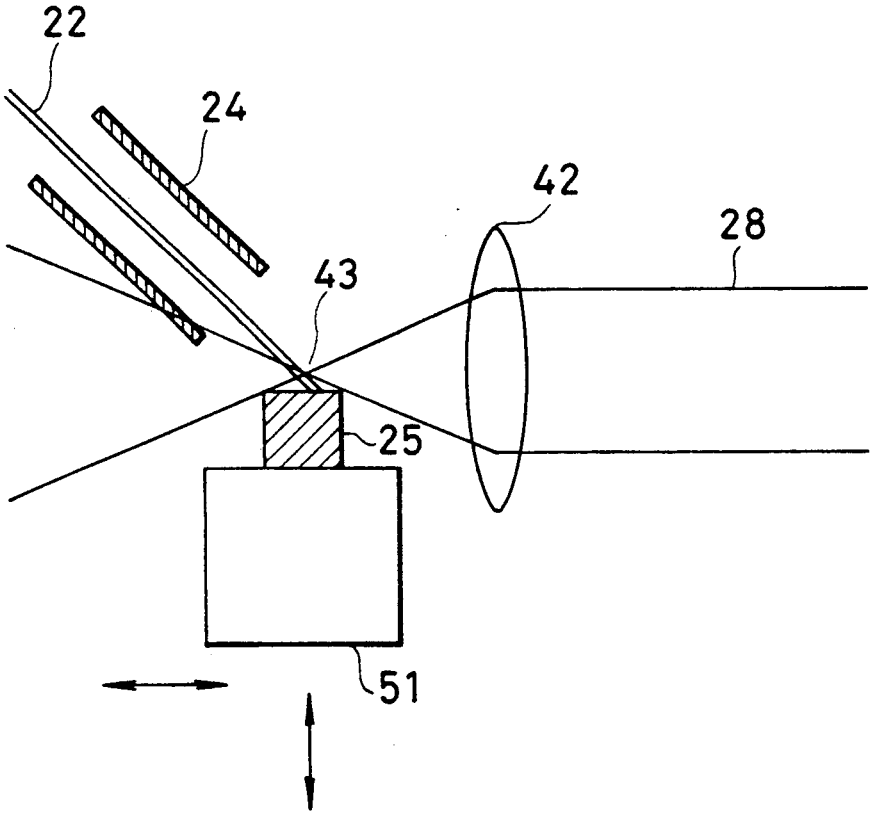
FIG. 6 is a schematic diagram showing an embodiment of an apparatus according to the present invention whose laser ionization region is brought close to the sputtering surface.

FIG. 6 shows an embodiment of the present invention in which the laser beam 28 is converged and the laser ionization region is brought close to the surface to be sputtered. The laser beam 28 is converged through a condenser lens 42 and the sample 25 is formed as small as possible, as shown in FIG. 6. A sample moving mechanism 51 is provided to move the sample 25 to a position just under a position at which the laser beam 28 is converged. The ion beam 22 is adjusted by the scanning electrode 24 so as to ensure the irradiation of the surface fo the sample 25. The apparatus having the foregoing construction makes it possible to establish a photoionization region 43 at the position immediately above the surface to be sputtered and to set a distance between the surface of the sample 25 and the photoionization region 43 to be of the order of several hundreds of micrometers.

EMBODIMENT 3

Photoions per se migrate towards every direction in the vacuum chamber 45 unless any measure is taken. Therefore, a predetermined voltage must be applied to the ions to guide them to the mass analyzer 31 in order to effectively detect the ions. If a quadrupole mass analyzer is employed as the mass analyzer 31, ions which move at a high speed deteriorate the mass resolution.

Figure 7:
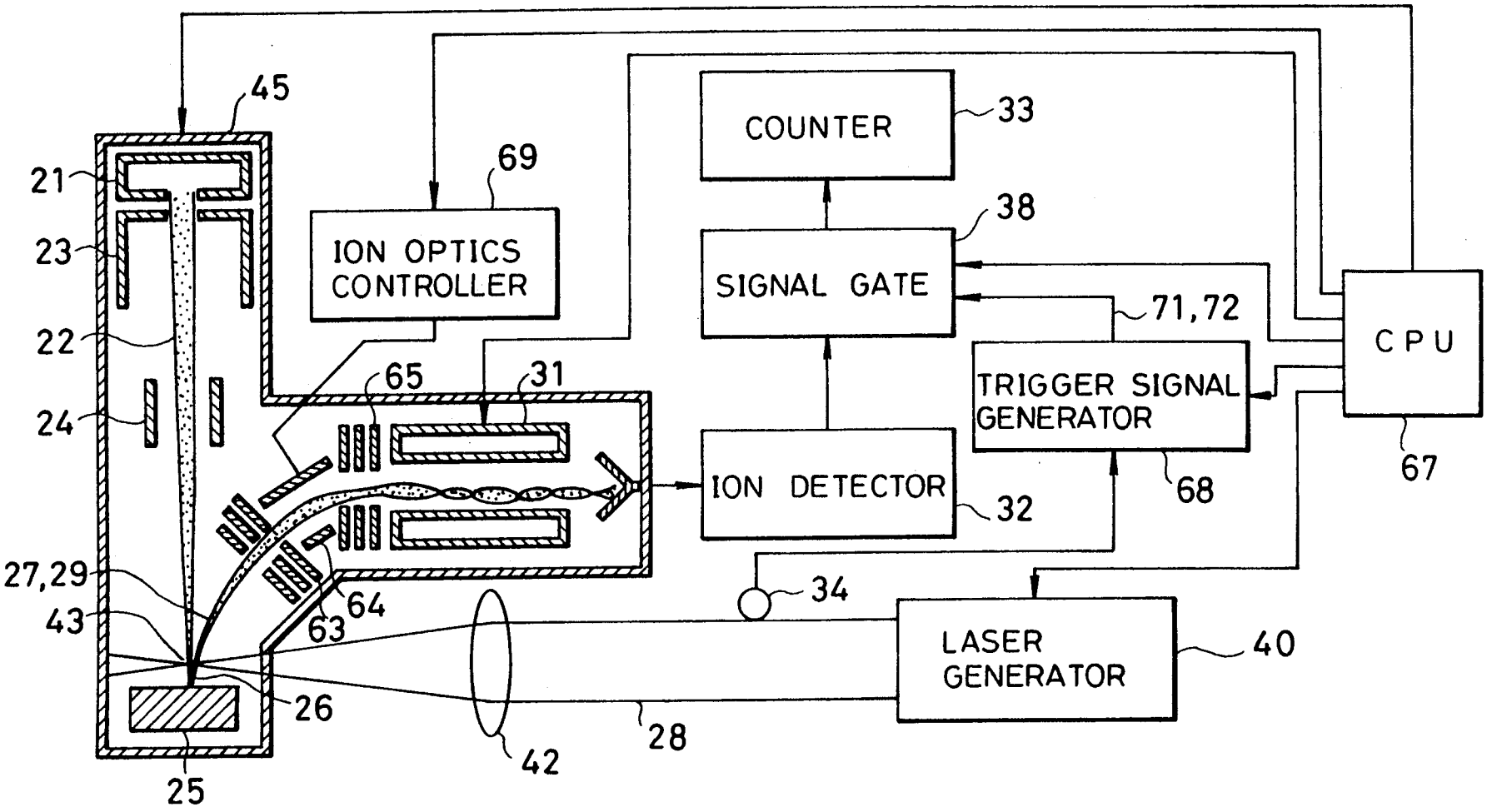
FIG. 7 is a schematic diagram showing an embodiment of an apparatus according to the present invention in which a quadrupole mass analyzer is used.

Thus, if ion optics as shown in FIG. 7 are provided to filter out only ions having any desired kinetic energy to collect the ions, the sensitivity of the mass analysis can be enhanced while making the most use of the advantages of the quadrupole mass analyzer. The neutrals discharged from the sample 25 are converted into photoions 29 in the ionization region 43. The photoions 29 are collected by a first ion lens 63. A potential gradient is established by the action of two sheets of electrodes 64 to deflect the ion orbit to remove the ions having a high speed among the collected ions, and thereby only ions having a desired kinetic energy being passed through. In this respect, the ions having a high speed go straight ahead and, therefore, only ions having a low speed are incident upon the quadrupole mass analyzer 31 through a second ion lens 65. In this case, if the energy resolution is high due to the potential gradient, the speeds of the ions are substantially the same. As a result, a period of time for ion-detection becomes narrower. With this in view, the ion optics must be designed so that the ions having a high speed are removed to collect ions having an energy distribution over a broad range as much as possible.

In the embodiment shown in FIG. 7, this is accomplished by the ion lens 65 which collects ions spread due to the action of the potential gradient.

A period of time required for the photoion 29 generated by the pulse leaser 40 reaching the ion detector 32 is approximately in proportion to the square root of the mass of the ion and is in inverse proportion to the square root of the energy thereof. Moreover, the lower the energy resolution of the ion optics 63, 64 and 65, the broader the period of time required that the ion reaches the detector. For this reason, if a set value of the gate time of the signal gate 38 is varied depending in factors such as a mass of an ion, an energy resolution of the ion optics and so on, the measurement can thus be performed at the optimum sensitivity.

For this purpose, a mass to be separated by the mass analyzer 31 and a voltage to be applied to the ion optics 63, 64 and 65 are established by a CPU 67 and simultaneously a trigger signal generator 68 is controlled so as to generate a detection initiation signal 71 and a termination signal 72 in accordance with the established mass and energy of the ions. The detection initiation signal 71 and the termination signal 72 are applied to the signal gate 38 disposed between the ion detector 32 and the pulse counter 33 to thus define the measurement enabling time period Te which enables the detection of ions. This operation permits the establishment of a measurement enabling time period Te for ions having a desired energy and a desired mass, so that photoions can be detected at a high sensitivity. Reference numeral 69 denotes an ion optics controller for controlling voltages to be applied to the ion optics 63, 64 and 65, under the control by the CPU 67.

EMBODIMENT 4

Figure 8:
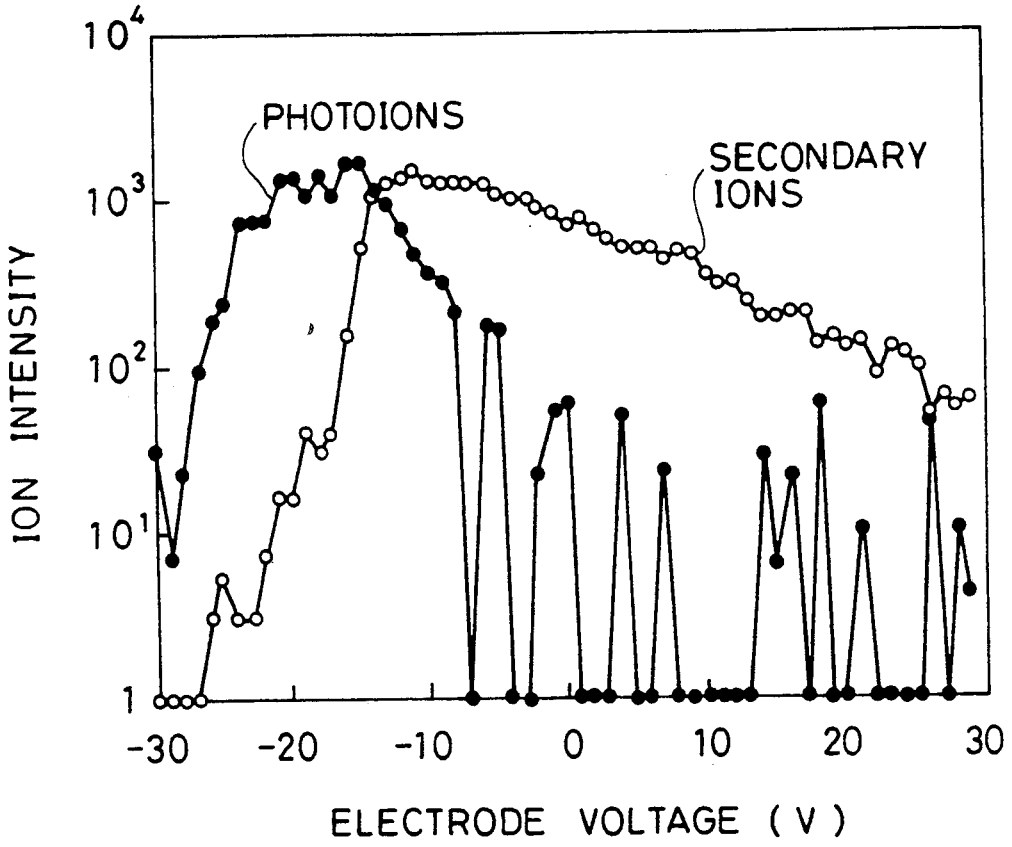
FIG. 8 is a characteristic curve graph illustrating results of the energy analysis of photoions and secondary ions carried out by using an apparatus of the present invention.

The initial energy of the secondary ions 27 generated from the sample 25 is greater than that of the neutrals 26. Energies of the secondary ions 27 and the photoions 29 are analyzed by the foregoing ion optics 63, 64 and 65. The results obtained are shown in FIG. 8. In FIG. 8, a potential difference of the electrode 64 of the ion optics shown in FIG. 7 is plotted as abscissa. Here, the lower the potential difference, the lower the kinetic energy of the ion to be subject to energy analysis, while an intensity of the ion mass-analyzed is plotted as ordinate. As is shown in FIG. 8, the secondary ions are detected on the high energy side. Accordingly, it is possible to sequentially detect the secondary ions 27 and the photoins 29 having any desired mass by automatically performing the measurement control as will be explained below.

In FIG. 7, the mass analyzer 31, the laser generator 40, the ion optics controller 69 and so on are controlled by the CPU or measurement controller 67. In order that secondary ions 27 having a desired mass are detected, a set value of the mass analyzer 31 is adjusted to a desired mass and simultaneously an energy of the ion optics controller 69 is set at a value which provides the highest sensitivity with respect to the secondary ions shown in FIG. 8. The generation of the laser beam 28 is terminated and simultaneously the signal gate 38 is normally opened to interrupt the detection time limiting function. When the photoions 29 are detected, the laser beam 28 is generated and simultaneously the set value of the ion optics controller 69 is set at an energy which provides the highest sensitivity with respect to the photoions 29. Then, the laser beam 28 is generated and the operation of the signal gate 38 is started. It is possible to continuously detect secondary ions or neutrals having any desired mass by performing the foregoing operations continuously.

As has been explained above, the sensitivity of analysis can be improved according to the present invention. In addition, the present invention makes it possible to detect secondary ions at a sensitivity approximately comparable to that achieved by the conventional secondary ion mass analyzer. Thus, the present invention permits the analysis in which the advantages of both the sputtered neutral mass spectrometry and the secondary ion mass spectrometry are quite effectively achieved.

As has been discussed above in detail, the laser ionization sputtered neutral mass spectrometer according to the present invention comprises means for irradiating the surface of a solid sample to be analyzed with an ion beam in vacuo; means for generating a pulse laser which ionizes neutrals sputtered from the surface of the solid sample through the bombardment with the foregoing ion beam to generate photoions; means for mass-separating the photoions; and an ion detector for detecting the mass-separated photoions, wherein the foregoing pulse laser is a UV laser capable of being repeatedly emitted, the foregoing means for the mass separation serves to pass, therethrough, only ions having a desired mass while making use of an electric field and/or a magnetic field, and the foregoing ion detector comprises a gate means for outputting the detected ions during a period of time that the photoions passing through the mass separation means are predicted to reach the detector and means for counting the number of ions reached the detector. Accordingly, the primary ion beam can be continuously detected and the sensitivity of the ion detection system can be greatly improved. Thus, the present invention makes it possible to enhance the resolution in the direction of the depth of a sample and to hence improve the sensitivity of the analysis.

Moreover, since the mass spectrometer according to the present invention is provided with means for simultaneously interrupting and operating the foregoing laser generator and the gate means, the present invention makes it possible to detect secondary ions at a sensitivity approximately comparable to that achieved by the conventional secondary ion mass analyzer. Thus, the present invention permits the analysis in which the advantages of both the sputterred neutral mass spectrometry and the secondary ion mass spectrometry are very effectively attained.

Furthermore, the mass spectrometer according to the present invention is provided with ion optics serve as an energy analyzer for making only the secondary ions of photoions having a desired kinetic energy incident upon the mass analyzer and which are disposed in the prestage of the mass analyzer and, therefore, the secondary ions and the photoions can be detected with a higher sensitivity.

The invention has been described in detail with respect to preferred embodiments, and it will now be apparent from the foregoing to those skilled in the art that changes and modifications may be made without departing from the invention in its broader aspects, and it is the invention, therfore, in the appended claims to cover all such changes and modifications as fall within the true spirit of the invention.

What is claimed is:

1. A laser ionization sputtered neutral mass spectrometer, comprising:

a vacuum chamber;

a pulse laser means disposed in said vacuum chamber for irradiating an ion beam on a surface of a solid sample to be analyzed;

means for generating a UV pulse laser beam for ionizing neutrals sputtered from said surface of said solid sample by bombardment with said ion beam to generate photoions, and which is capable of repeatedly emitting laser pulses;

a mass separation means disposed in said vacuum chamber for mass-separating and passing, therethrough, only ions having a desired mass of at least one of secondary ions and said photoions sputtered from said surface of said solid sample through said bombardment with said ion beam;

an ion detecting means for detecting said ions derived from said mass separation means to output pulse outputs;

a gate means for extracting said pulse outputs from said ion detecting means only during a period of time from an instant that said photoions passing through said mass separation means reach said ion detecting means to an instant that said ions are detected; and a counting means for counting the number of said pulse outputs extracted from said gate means.

2. The laser ionization sputtered neutral mass spectrometer as claimed in claim 1, wherein said mass separation means is a quadrupole mass analyzer.

3. The laser ionization sputtered neutral mass specrtometer as claimed in claim 1, further comprising a condenser lens for coverging said laser beam from said pulse laser means and means for adjusting a converging position of said laser beam so that said converging position is positioned immediately above said suface to be sputtered of said solid sample.

4. The laser ionization sputtered neutral mass specrtometer as claimed in claim 2, further comprising a condenser lens for converging said laser beam from said pulse laser means and means for adjusting a converging position of said laser beam so that said converging position is positioned immediately above said surface to be sputtered of said solid sample.

5. The laser ionization sputtered neutral mass spectrometer as claimed in claim 2, further comprising ion optics disposed in a prestage of said quadrupole mass analyzer and for removing only ions having a high energy among said photoions generated.

6. The laser ionizaton sputtered neutral mass spectrometer as claimed in claim 4, further comprising ion optics disposed in a prestage of said quadrupole mass analyzer and for removing only ions having a a high energy among said photoions generated.

7. The laser ionization sputtered neutral mass spectrometer as claimed in claim 1, further comprising means for changing the gate-opening time and gate-closing time of the gate means depending on the mass and the kinetic energy of the photoions.

8. The laser ionization sputtered netral mass spectrometer of claim 2, further comprising means for changing an instant that said gate means is opened and an instant that said gate means is closed in accordance with the mass and the kinetic energy of said photoions.

9. The laser ionizaton sputtered neutral mass spectrometer as claimed in claim 3, further comprising means for changing an instant that said gate means is opened and an instant that said gate means is closed in accordance with the mass and the kinetic energy of said photoions.

10. The laser ionization sputtered neutral mass spectrometer as claimed in claim 5, further comprising means for changing an instant that said gate means is opened and an instant that said gate means is closed in accordance with the mass and the kinetic energy of said photoions.

11. The laser ionization sputtered neutral mass spectrometer as claimed in claim 6, further comprising means fro changing an instant that said gate means is opened and an instant that said gate means is closed in accordance with the mass and the kinetic energy of said photoions.

12. The laser ionizaton sputtered neutral mass spectrometer as claimed in claim 1, further comprising means for simultaneously enabling or disabling the generation of said laser beam from said pulse laser means and said gate means, said photoions being detected when said pulse laser means and said gate means are enabled, and said secondary ions being detected when said pulse laser means and said gate means are disabled.

13. The laser ionization sputtered neutral mass spectrometer as claimed in claim 5, further comprising means for setting an energy of said ion optics at a level which provides the highest sensitivity with respect to said secondary ions while said secondary ions are detected.

* * * * *